United States Patent [19]

Soffge et al.

[11] 4,297,759

[45] Nov. 3, 1981

[54] FLOATING BRIDGE

[75] Inventors: Friedhelm Soffge, Kornwestheim; Hans Weigele, Stuttgart, both of Fed. Rep. of Germany

[73] Assignee: Dr. Ing. h.c.F. Porsche AG, Stuttgart, Fed. Rep. of Germany

[21] Appl. No.: 97,122

[22] Filed: Nov. 26, 1979

[30] Foreign Application Priority Data

Nov. 24, 1978 [DE] Fed. Rep. of Germany ..... 2850848

[51] Int. Cl.[3] ..... E01D 15/14

[52] U.S. Cl. ..... 14/2.6; 14/27

[58] Field of Search ..... 14/27, 2.4, 2.6, 28; 405/219

[56] References Cited

U.S. PATENT DOCUMENTS

| | | | |
|---|---|---|---|
| 3,021,544 | 2/1962 | Gillois | 14/27 |
| 3,066,332 | 12/1962 | Sedlacek | 14/27 X |
| 3,208,087 | 9/1965 | Edwards | 14/27 X |
| 3,499,179 | 3/1970 | Weld | 14/27 |
| 3,504,389 | 4/1970 | Longbottom | 14/27 |
| 3,651,528 | 3/1972 | Behrmann | 14/27 X |

*Primary Examiner*—Nile C. Byers, Jr.

*Attorney, Agent, or Firm*—Craig and Antonelli

[57] ABSTRACT

A transportable floating bridge includes a bridge unit, a buoyant pontoon for supporting the bridge unit, a device carried by the pontoon for lifting and pivoting the bridge unit, a coupler for swingingly linking the bridge unit to a like pontoon supported bridge unit, and a coupling for rigidly coupling the bridge units together, whereby the floating bridge is easily formed from a plurality of bridge units regardless of whether the bridge units are located end-to-end or side-by-side after off-loading from their transport vehicle.

6 Claims, 8 Drawing Figures

FLOATING BRIDGE

BACKGROUND AND SUMMARY OF THE INVENTION

The invention relates to a floating bridge for transportation and transfer by means of a vessel, comprising a buoyant pontoon and a bridge borne thereon that is pivotably disposed on the pontoon, for formation of a bridge unit that consists of a plurality of bridges.

Floating bridges are known (German AS No. 1,939,116) that are pivotably borne on a pontoon and that can be off-loaded in the water by an off-loading device of a vessel. During the off-loading process, the bridge is held longitudinally on the pontoon. For putting together a floating bridge unit that comprises a plurality of bridges, the bridges are pivoted on the pontoons so that they are disposed crosswise thereto. The bridges are fixedly joined via frontal coupling means.

Such bridges have to be in an exact position with respect to each other, to form a bridge unit, in order that a firm connection between them can be ensured. Constant maneuvering of the pontoons is necessary for this, until the coupling position is attained, and this is often associated with difficulties in rough water or with adverse wind conditions.

The invention therefore concerns the problem of simplification of the operation of putting the bridges in a coupling position, so that the off-loading time for production of a continuous long bridge unit comprising a plurality of bridges can be kept to a minimum.

This problem is solved according to a preferred embodiment of the invention in that a lifting and pivoting device disposed in retaining elements on the pontoon side serves for pivoting the bridges, and in that off-loading the bridges are first received in a rotatable fixing device and then firmly joined by a coupling device. According to an example of embodiment of the invention, it is provided that for formation of a floating bridge comprising a plurality of bridges, the bridges which are disposed more or less in parallel next to each other can be hung at the corners by means of the fixing device, and can be shifted by the pivoting and lifting device into a position for frontal connection. It is further provided that the lifting and pivoting device includes an external housing braced on the pontoon, and a pivot mount borne therein, so as to be rotatable and adjustable in height, which pivot mount presents retaining elements for connection with the bridge. The pivot mount has a centrally disposed lift cylinder braced on the pontoon, said cylinder being connected with a pivot drive, whereby the pivot drive is comprised of an adjusting cylinder that engages a bracket of the pivot mount or of the lift cylinder, the said adjusting cylinder being braced on the housing. It is further provided according to the preferred embodiment of the invention that the fixing device includes a rotatably borne funnel-shaped receiving part as well as a rotatably borne counter piece shaped like a conical mandrel that is received thereby, and these parts are disposed respectively at the corners of the tracks of the bridges that are to be joined, and are engaged for the connection.

The advantages that derive from the invention are essentially to be seen in that the bridges are simply connectable by mutual fixation, and are firmly connectable with each other by a pivoting of the bridges on the pontoons without any further correction of position, and thus a plurality of bridges can be coupled to form a bridge unit in the briefest period of time. Time-consuming maneuvering of the pontoons for connection of the bridges can thus be eliminated.

These and other objects, features and advantages of the present invention will become more apparent from the following description when taken in connection with the accompanying drawings which show, for purposes of illustration only, one embodiment in accordance with the present invention.

DETAILED DESCRIPTION OF THE PREFERRED EMBODIMENT

Figure 1:
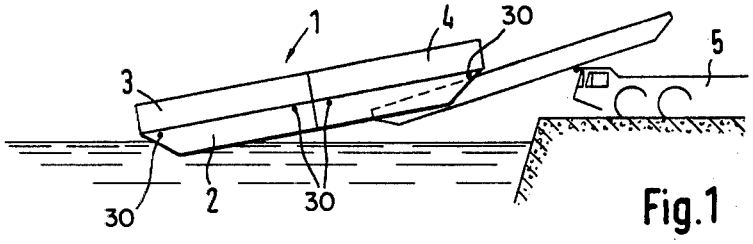
FIG. 1 schematically shows a lateral view of an off-loading craft with a floating bridge that is to be laid in the water.

A floating bridge 1 comprises bridge parts 3 and 4 held on a pontoon 2. Pontoon 2 together with bridge parts 3 and 4 that form a bridge 1 can be transported on a vehicle 5 from which it can be off-loaded and taken up again by an off-loading device forming no part of the present invention. Rollers 30 are provided for this off-loading purpose.

Bridge 1 is held on pontoon 2 by means of a lifting and pivoting device 6 that is both rotatable and adjustable in height. A fixing device 7 (FIG. 7) serves for initially connecting a pair of like bridges 1 (FIG. 2) with each other, after which fixed coupling of the two bridges together is easily effected by a coupling device 8.

The lifting and pivoting device 6 is disposed in the middle of pontoon 2 and is braced on it by way of transverse supports 9 and is fixedly connected with bridge 1 between the tracks on a transverse support 10. This fixed connection can be of a releasable type. The device 6 comprises an external housing 11 in which a pivot drive 12 is disposed so that it can be pivoted and adjusted in height. Pivot drive 12 presents retaining devices 13 for connection of the drive with bridge 1, said retaining devices 13 engaging rollers 14 on the inner long sides of tracks 15 and 16 of bridge 1 to effect fastening of pivot drive 12 on bridge 1, and by constructing rollers 14 and retaining device 13 for relative displacement, the fastening can be releasable.

The pivot drive 12 has a foot 17 which is connected with a lift cylinder 18 that is braced on outer housing 11 and effects a shift in height of bridge 1 before the actual pivoting process. For this purpose, a slide bearing 19 is provided between housing 11 and pivot drive 12. Lift cylinder 18 is used to cause bridge 1 to be lifted slightly before the bridge parts are pivoted, so that it is easy to turn them and so that they will be lifted out of locks on pontoon 2.

For pivoting bridge 1 on pontoon 2, there are two oppositely disposed adjusting cylinders 20, 21 that engage the lift cylinder 18 via a bracket 22. These adjusting cylinders 20, 21 are braced on housing 11 and are connected with bracket 22 by their piston rods so that they effect a rotation of lift cylinder 18 and thereby of pivot drive 12.

The fixing device 7 (FIG. 7) is disposed on the respective outer corners 23 of tracks 15 and 16 and comprises a receiving part 24 and a counter piece 25 that is received thereby. The receiving part and the counter piece are rotatably mounted on tracks 15, 16 of bridge 1. Receiving part 24 can be made in a funnel configuration, for example, in which a conical mandrel forming counter piece 25 engages.

Coupling device 8 comprises coupling elements 26, 27 which are of a conventional type, e.g., in the form of a claw coupling, by which lower flange 28 and upper flange 29 of tracks 15 and 16 can be connected with each other, via the coupling elements. Coupling only occurs when the frontal surfaces of the bridges are applied against each other. During the pivoting process the coupling claws are open (dotdash line position).

Figure 2:
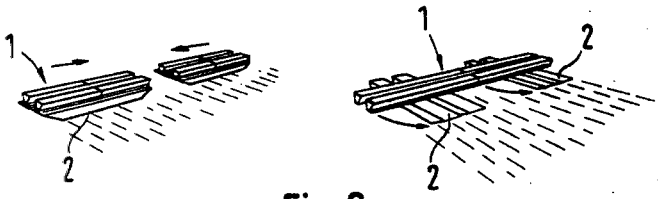
FIG. 2 is a schematic view of a way of connecting two floating bridges, disposed one behind the other.
Figure 3:
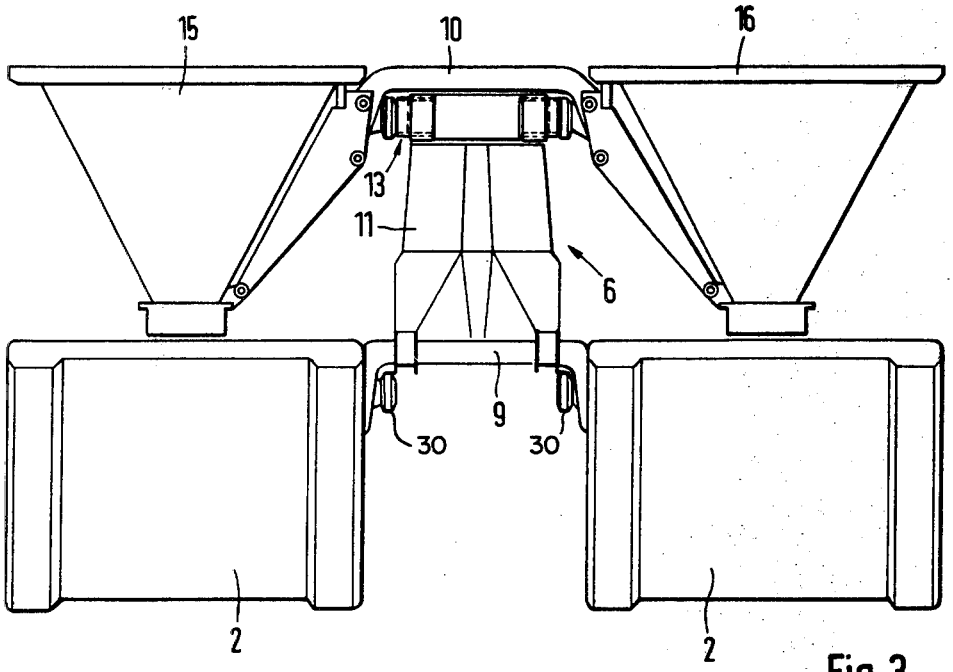
FIG. 3 schematically shows a cross-section of a floating bridge.
Figure 4:
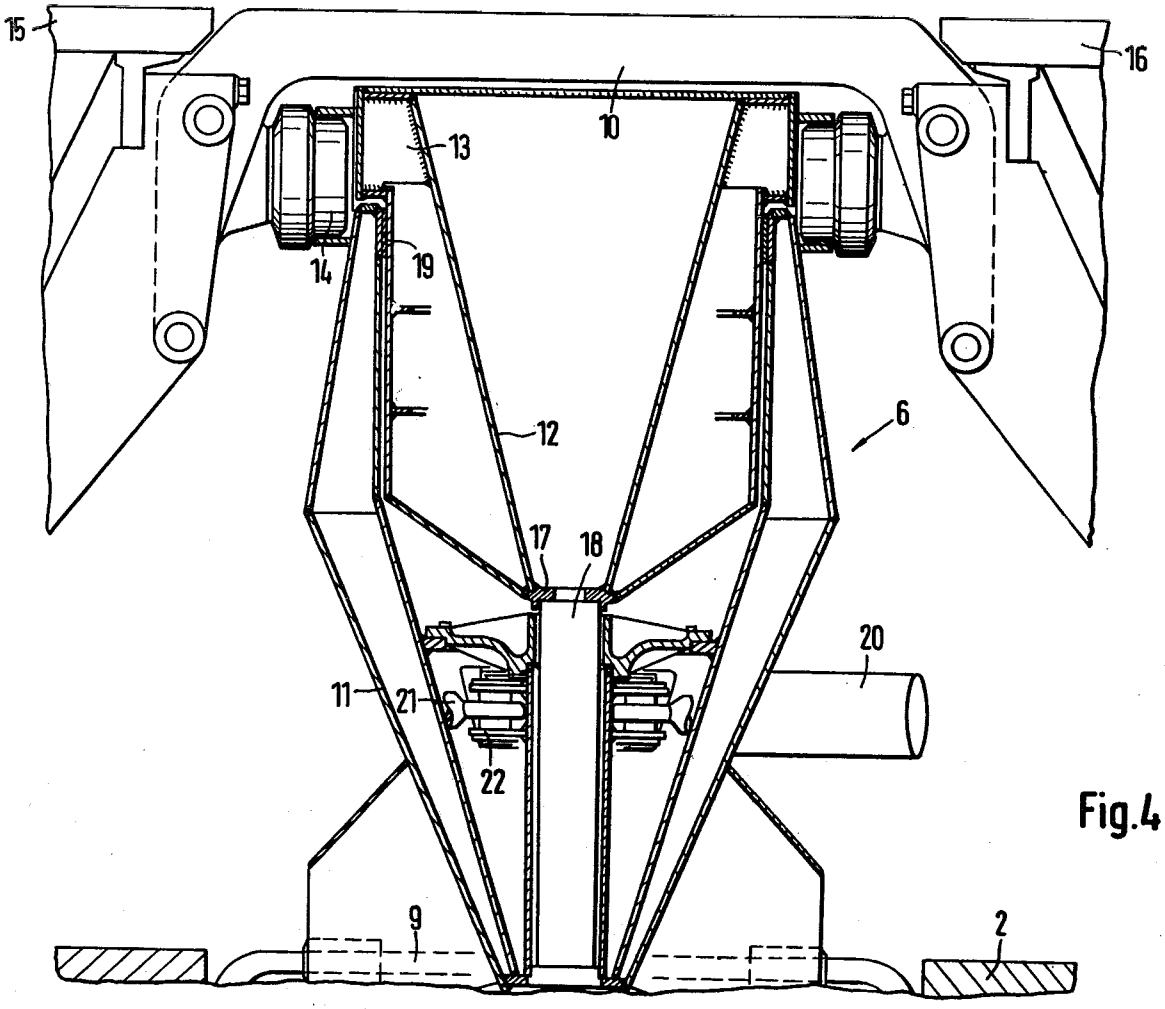
FIG. 4 is a cross-section through a lifting and pivoting device.
Figure 5:
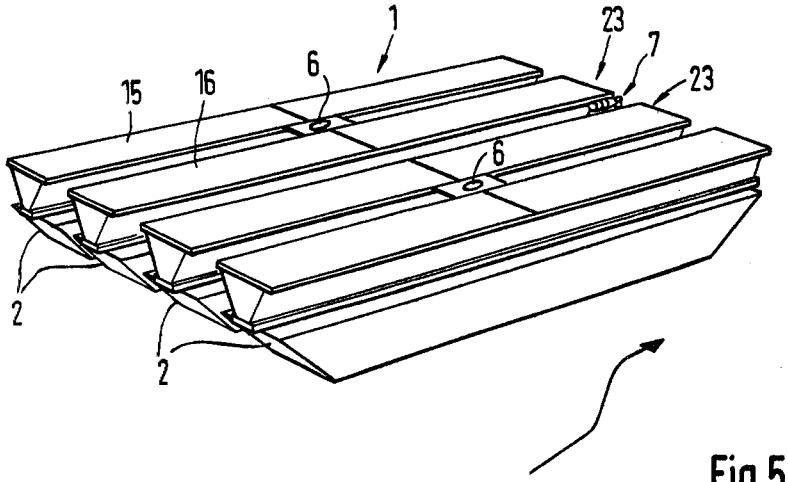
FIGS. 5 and 6 schematically show a way of connecting two floating bridges floating side-by-side.
Figure 8:
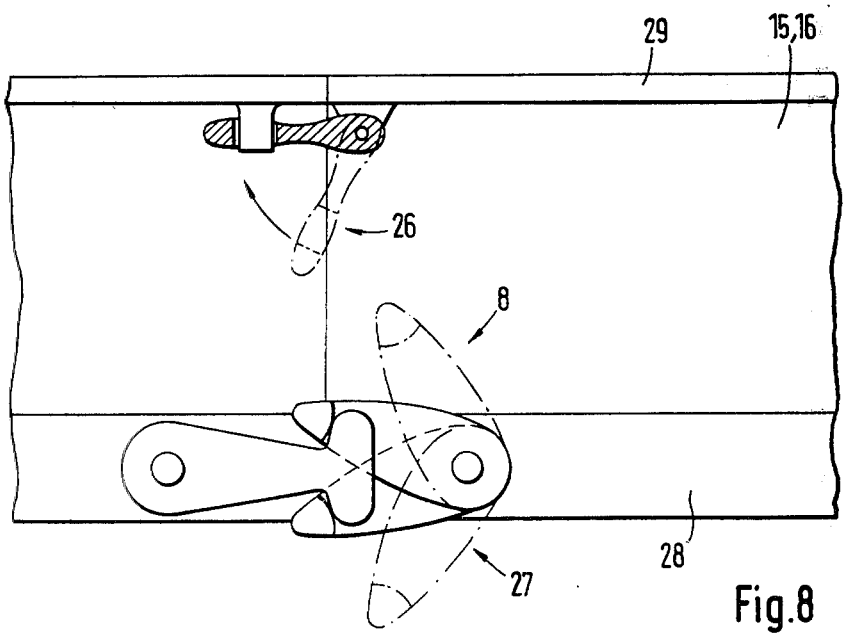
FIG. 8 shows a coupling device.
Figure 6:
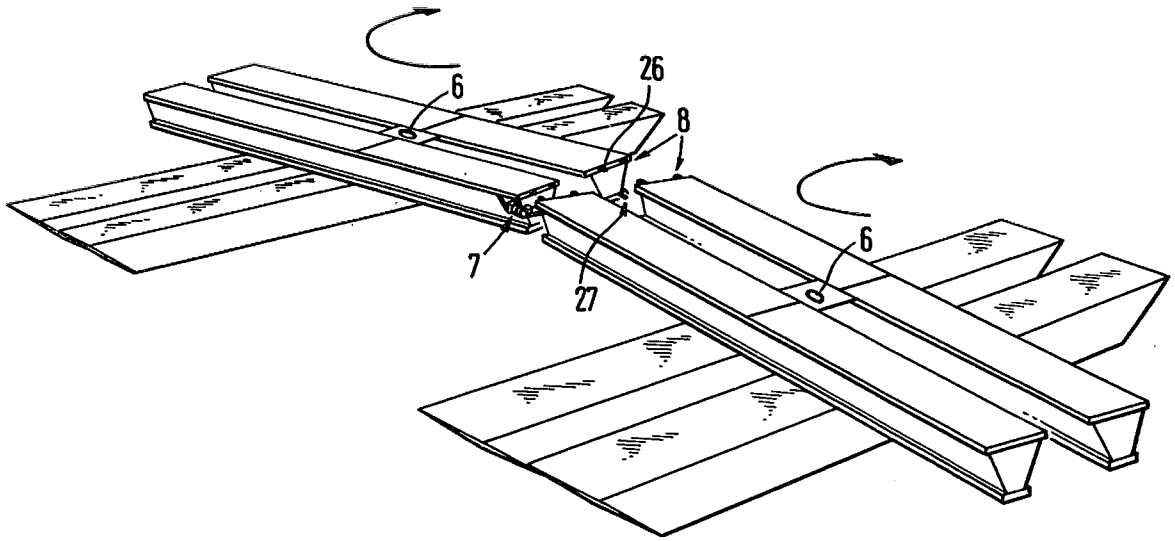

As the examples of embodiment according to FIGS. 2 and 5, 6 show in more detail, there are two possibilities for interconnection of the floating bridges.

In the example of embodiment according to FIG. 2, bridges 1 are disposed in the longitudinal direction of pontoon 2. For connection of these two floating bridges, pontoons 2 are moved frontally toward each other, the bridges are coupled by elements 26, 27, and then pontoons 2 are swung by an angle of 90° with reference to bridges 1, this occurring via pivoting device 6.

Figure 7:
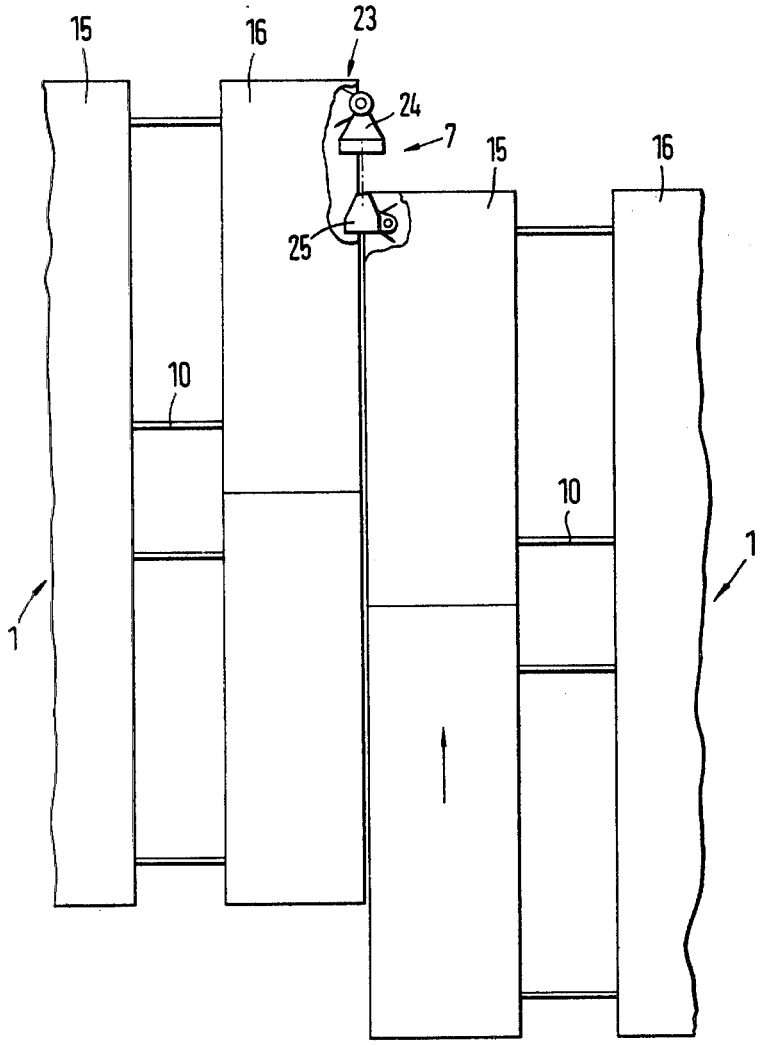
FIG. 7 shows a fixing device on two side-by-side floating bridges.

According to the second example of embodiment of FIGS. 5, 6 and 7, the two floating bridges 1 that are to be connected are floated more or less parallel next to each other. In such a case, parts 24 and 25 of fixing device 7 can come into engagement (FIG. 7). After the fixation of the two bridge parts 1 that still lie closely next to each other by device 7, bridges 1 are lifted by the lifting device that is integrated in pivot device 6, and rotated by pivot device 6 by an angle of 90° with reference to pontoon 2. The lifting of the bridges before the pivoting serves to free bridges 1 from pontoons 2 and from the locks on pontoons 2, so that the pivoting can be effected simply. During the pivoting by 90° with reference to pontoon 2, pontoons 2 are pushed apart in parallel (FIG. 6). After the bridges have assumed a position one behind the other, they are connected by coupling device 8.

Accordingly, it can be seen that the present invention is a floating bridge that can be easily formed from a plurality of bridge units regardless of whether the bridge units are located end-to-end or side-by-side after off-loading.

While we have shown and described only one embodiment in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

What is claimed is:

1. A transportable floating bridge comprising a bridge unit, a buoyant pontoon means supporting said bridge unit, displacement means carried by said pontoon means for lifting and pivoting said bridge unit, rotatable fixing means carried by the bridge unit for swingably linking said bridge unit to a like pontoon means supported bridge unit in a manner enabling relative rotation therebetween in a horizontal plane, and coupling means carried by the bridge unit for rigidly coupling said bridge unit to said like pontoon means supported bridge unit.

2. A transportable floating bridge according to claim 1, wherein said rotatable fixing means is disposed at at least one corner of said bridge unit.

3. A transportable floating bridge as in claim 1 or 2, wherein said displacement means comprises an outer housing braced on said pontoon means and a pivot mount carried within said housing in a rotatable and height adjustable manner, said pivot mount being coupled to said bridge unit.

4. A floating bridge as in claim 3, characterized in that the pivot mount comprises a centrally disposed lift cylinder braced on the pontoon means, which cylinder is connected with a pivot drive.

5. A floating bridge as in claim 4, characterized in that the pivot drive comprises adjustment cylinders that engage a bracket associated with one of the pivot mount and the lift cylinder, said cylinders being braced on the housing.

6. A floating bridge as in claim 1 or 2, characterized in that the fixing means comprises a rotatably borne funnel-shaped receiving part and a rotatably borne complementarily shaped counter piece, said receiving part and counterpiece being respectively disposed at opposing corners of tracks of the bridge unit for enabling one of the receiving part and counter piece of the bridge unit to be engageable together with the other of said receiving part and counter piece of the like bridge unit.

* * * * *